US008818007B2

(12) United States Patent
Robert

(10) Patent No.: US 8,818,007 B2
(45) Date of Patent: Aug. 26, 2014

(54) MEMS-TYPE PRESSURE PULSE GENERATOR

(75) Inventor: Philippe Robert, Grenoble (FR)

(73) Assignee: Commissariat a l'energie atomique et aux energies alternatives, Paris (FR)

( * ) Notice: Subject to any disclaimer, the term of this patent is extended or adjusted under 35 U.S.C. 154(b) by 476 days.

(21) Appl. No.: 13/184,858

(22) Filed: Jul. 18, 2011

(65) Prior Publication Data

US 2012/0018244 A1 Jan. 26, 2012

(30) Foreign Application Priority Data

Jul. 22, 2010 (FR) ..... 10 56001

(51) Int. Cl.

| | |
|---|---|
| ***H04R 25/00*** | (2006.01) |
| ***H04R 31/00*** | (2006.01) |
| ***H04R 19/00*** | (2006.01) |
| ***H04R 17/00*** | (2006.01) |
| ***B06B 1/02*** | (2006.01) |
| ***H04R 23/00*** | (2006.01) |
| *G10K 15/04* | (2006.01) |
| *H04R 1/00* | (2006.01) |

(52) U.S. Cl.

CPC ..... *H04R 19/005* (2013.01); *H04R 31/00* (2013.01); *H04R 2201/003* (2013.01); *H04R 2400/00* (2013.01); *H04R 1/005* (2013.01); *H04R 17/00* (2013.01); *B06B 1/0292* (2013.01); *H04R 23/002* (2013.01)

USPC ..... 381/175; 181/142

(58) Field of Classification Search

CPC ..... B06B 3/00; B41J 5/08; G01S 1/72; G10K 15/04; G10K 15/043; H04R 19/04; H04R 19/005; H04R 10/016; H04R 23/006

USPC ..... 381/175; 257/254; 181/142

See application file for complete search history.

(56) References Cited

U.S. PATENT DOCUMENTS

2002/0009202 A1 1/2002 Sheplak et al.
2005/0052723 A1 3/2005 Watanabe et al.

(Continued)

FOREIGN PATENT DOCUMENTS

DE 10 2005 008 511 A1 8/2006
EP 1 978 779 A2 10/2008

(Continued)

OTHER PUBLICATIONS

French Preliminary Search Report issued Mar. 1, 2011 in FR 1056001.

(Continued)

*Primary Examiner* — Brian Ensey

(74) *Attorney, Agent, or Firm* — Oblon, Spivak, McClelland, Maier & Neustadt, L.L.P.

(57) ABSTRACT

A device and method for generating or recovering acoustic energy are provided, including a substrate; at least one deformable cavity disposed in the substrate and being delimited by at least one mobile or deformable wall, the at least one deformable cavity extending in a lateral direction in the substrate defined by a first plane parallel to an upper surface of the substrate; at least one opening disposed in an upper portion of the at least one deformable cavity, configured to transmit at least one pulse produced in the at least one deformable cavity to an ambient atmosphere, the at least one pulse being a pressure pulse, a depression pulse, a partial vacuum pulse, or a combination thereof; and at least one actuator configured to generate a force in the first plane that displaces or deforms, or displaces and deforms, the at least one mobile or deformable wall.

27 Claims, 9 Drawing Sheets

(56) References Cited

U.S. PATENT DOCUMENTS

| | | | |
|---|---|---|---|
| 2007/0222011 | A1 | 9/2007 | Robert et al. |
| 2008/0123242 | A1 | 5/2008 | Zhou |
| 2008/0267431 | A1 | 10/2008 | Leidl et al. |
| 2010/0002543 | A1 | 1/2010 | Schlosser et al. |

FOREIGN PATENT DOCUMENTS

| | | | |
|---|---|---|---|
| FR | 2 951 826 | | 4/2011 |
| GB | 2 218 303 | A | 11/1989 |
| JP | 58-56895 | | 3/1983 |
| WO | WO 93/19561 | A1 | 9/1993 |
| WO | WO 94/14240 | A1 | 6/1994 |
| WO | WO 01/19133 | A1 | 3/2001 |
| WO | WO 2005/031299 | A2 | 4/2005 |
| WO | WO 2010/038229 | A2 | 4/2010 |

OTHER PUBLICATIONS

Matthias Winter, et al., "Influence of a chip scale package on the frequency response of a MEMS microphone", Microsystem Technologies; Micro and Nanosystems Information Storage, and Processing Systems, Springer, Berlin, DE, vol. 16, No. 5, Dec. 25, 2009, pp. 809-815.

Kurt Petersen, et al., "Resonant Beam Pressure Sensor Fabricated with Silicon Fusion Bonding", vol. Conf. 6, Jun. 24, 1991, pp. 664-667.

Sazzadur Chowdhury, et al., "Nonlinear Effects in MEMS Capacitive Microphone Design", Proceedings of the International Conference on MEMS, NANO and Smart Systems (ICMENS 2003), 2003, 6 pages.

Alfons Dehe, "Silicon Microphone Development and Application", Sensor and Actuators A133, 2007, pp. 283-287.

M. Brauer, et al., "Improved Signal-to-noise Ratio of Silicon Microphones by a High-impedance. Resistor", J. Micromech. Microeng. 14 (2004), pp. 86-89.

Dr. Kaigham (Ken) J. Gabriel, Chairman & CTO, Akustica, PA 15203 USA, Sep. 29, 2005, RUL http://www.ece.cmu.edu/~izhu/class/18200/F05/Lecture05_Gabriel.pdf, 46 pages.

John J. Neumann Jr., et al., "C-MOS-MEMS membrane for audio-frequency acoustic actuation", Sensors and Actuators A 95 (2002), pp. 175-182.

Joerg Rehder, et al., "Balanced Membrane Micromachined Loudspeaker for Hearing Instrument Application", Institute of Physics Publishing, J. Micromech. Microeng. 11 (2001), pp. 334-338.

Brett M. Diamond, et al., "Digital Sound Reconstruction Using Arrays of CMOS-MEMS Microspeakers", Transducers '03—The 12$^{th}$ International Conference on Solid State Sensors, Actuators and Microsystems, Jun. 8-12, 2003, pp. 292-295.

Ryan Hickey, et al., Time and Frequency Response of Two-arm Micromachined Thermal Actuators, J. Micromech. Microeng., 13 (2003), pp. 40-46.

Fatima Lina Ayatollahi, et al., "Design and Modeling of Micromachined Condenser MEMS Loudspeaker using Permanent Magnet Neodymium-Iron-Boron (ND-Fe-B)", ICSE2006 Proc. 2006, pp. 160-166.

Matthew I. Haller, et al., "A Surface Micromachined Electrostatic Ultrasonic Air Transducer", 1994 Ultrasonics Symposium, pp. 1241-1244.

P. Rangsten, et al., "Electrostatically Excited Diaphragm Driven as a Loudspeaker", Solid-State Sensors and Actuators, 1995 and Eurosensors IX., Transducers '95, The 8$^{th}$ International Conference on, pp. 430-433.

Yongli Huang, et al., "Capacitive Micromachined Ultrasonic Transducers (CMUTs) with Isolation Posts", Ultrasonics 48 (2008), pp. 74-81.

Seung S. Lee, et al., "Piezoelectric Cantilever Acoustic Transducer", J. Micromech Microeng. 8 (1998) , pp. 230-238.

U.S. Appl. No. 13/186,697, filed Jul. 20, 2011, Robert, et al.

FIG.4A
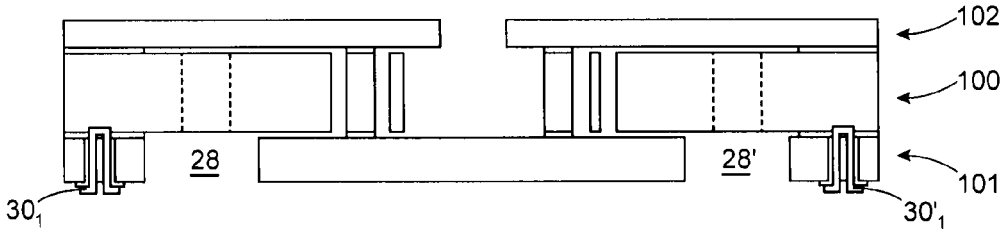
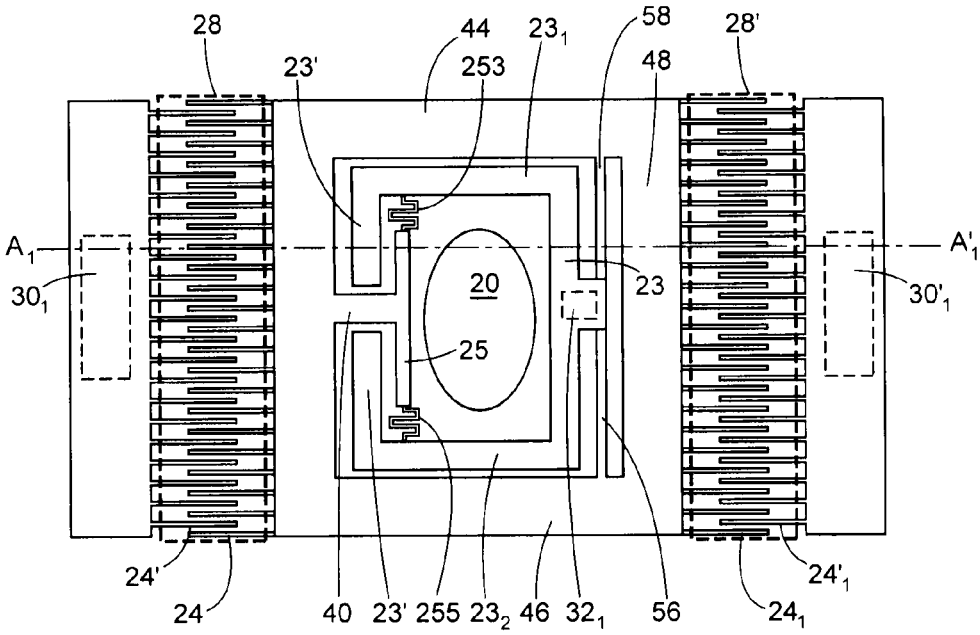
FIG.4B

MEMS-TYPE PRESSURE PULSE GENERATOR

TECHNICAL FIELD AND PRIOR ART

The invention relates to a MEMS- and/or NEMS-type pressure pulse generator.

It makes it possible to produce MEMS loudspeakers, digital MEMS loudspeakers, and cMUTs ("capacitive Micromachined Ultrasonic Transducer"). In fact, the generation of pressure pulses primarily concerns two applications: loudspeakers and cMUTs.

There are two approaches to making MEMS loudspeakers: a traditional approach, of the analog loudspeaker type, and another approach, of the digital loudspeaker type.

Analog loudspeakers are formed by a membrane actuated by electromagnetic, electrostatic, or piezoelectric means, at the frequency of the sound one wishes to restore. The restored sound volume will be proportional to the displacement amplitude of the membrane.

Some are made in MEMS form, as for example described in the article by Neumann J J et al, 2001, CMOS-MEMS membrane for audio frequency actuation *IEEE Int. Proc. MEMS* 2001-pp 236-9.

FIG. 1A shows the structure of a generator, as explained by J. Rehder et al. in "Balance membrane micromachined loudspeaker for hearing instrument application"—J. Micromech. Microeng. 11, 2001, 334-338. This generator includes a means forming a substrate 1 made from a magnetically soft material, electrodeposited cores, a means 3 forming electric contacts, coils 4, and permanent magnets 5. The sound produced comes out through an outlet 6. Reference 7 designates a membrane made from a non-magnetically soft material, and reference 8 designates a means forming a spacer.

However, the actuating amplitude of these MEMS membranes is very limited. The sound volume is consequently very reduced overall.

Furthermore, given the dimensions of these MEMS components, the restoration of bass (which requires a greater displacement amplitude to offset the decrease in sound levels caused by the drop in frequency, the sound level being directly proportional to the frequency) is practically impossible with acceptable levels.

Lastly, the great response non-linearity of the MEMS membranes (embedded on their perimeter) is very substantial, once one exceeds the vibration amplitudes in the vicinity of the thickness of the membrane. This results in a significant distortion even for low sound levels.

A second approach, much less traditional, called "digital loudspeaker," uses, as shown in FIG. 1B, an array 10 of membranes $\mathbf{10}_1, \mathbf{10}_2, \mathbf{10}_3, \ldots \mathbf{10}_n$, addressed individually and each generating an acoustic pressure pulse. The sound is then reconstructed by adding these pressure "bits." The amplitude of the vibration is then determined by the number of membranes addressed at the same time, and the restored frequency is determined by varying this amplitude as a function of time.

Very few articles deal with this type of loudspeaker. The only MEMS example embodiment is described by Brett M. Diamond et al. in "Digital Sound Reconstruction Using Arrays Of Cmos-Mems Microspeakers," TRANSDUCERS '03—The 12th International Conference on Solid State Sensors, Actuators and MicrosystemS. Boston, Jun. 8-12, 2003. It uses an electrostatic-type actuation.

In the case of a digital loudspeaker, to restore good quality sound, it should be possible to:

- generate pressure and vacuum pulses, with sufficient amplitudes and, if possible, the same intensity and shape (rise time and fall time of the membrane),
- control the rising edge and falling edge of the membrane, both for pressure pulses and vacuum pulses.

However, in the case of the device proposed in the document cited above, the suspended membrane is actuated by electrostatic means of the air gap variation type.

This membrane can only be electrostatically actuated in a single direction to generate a pressure (or depression or partial vacuum) pulse. Furthermore, the simple mechanical relaxation of the membrane is used to generate a reverse depression or partial vacuum (or pressure) pulse. This configuration makes it practically impossible to generate identical pressure or depression or partial vacuum pulses.

Another problem is that the use of an electrostatic actuation with air gap variation involves a nonlinear deformation amplitude of the membrane as a function of the applied voltage. This makes it very difficult to control the rising and falling edge. In the case of a pulse generated by mechanical relaxation of the membrane, the return to equilibrium of the membrane depends solely on its mechanical properties. The deformation as a function of time therefore cannot be electrically controlled. This also makes it impossible to attenuate the vibration bounces that have a substantial impact on the sound characteristics of the device.

Lastly, the use of an electrostatic actuation with air gap variation assumes that a deformation amplitude greater than ⅓ of the air gap is not exceeded, to avoid "pull-in." The "pull-in" voltage is the voltage from which the electrostatic force becomes substantial enough that the system becomes unstable. There is then a risk of adhesion of the two armatures of the capacitance of the electrostatic actuator. This consequently greatly limits the accessible deformation amplitude for a given maximum voltage (amplitude/gap and gap/max voltage compromise).

The cMUTs are for example described in the article "Capacitive micromachined ultrasonic transducers (CMUTs) with isolation posts" by Yongli Huanga et al., which appeared in Ultrasonics, Volume 48, Issue 1, March 2008, Pages 74-81.

The cMUTs in particular have very limited pressure levels. This limitation is due in particular to the low accessible vibration amplitudes for each of the cMUT membranes. This maximum vibration amplitude comes from a compromise between the value of the gap between the membrane and the excitation electrode (therefore the "pull-in"), the maximum allowed voltage (less than 100 V for safety reasons) and the breakdown voltage in the insulating oxide.

Reliability problems with this type of device are due to the charging of the dielectrics, already mentioned in the article cited above. Difficulties can also be mentioned in generating pressures of different frequencies on the same component in the case of a coupled use of these cMUTs in imaging (>10 MHz) and therapy (<5 MHz). This assumes, in fact, having 2 very different gap thicknesses to be able to maintain a comparable supply voltage for the two frequencies. This aspect makes the current technology very complicated.

BRIEF DESCRIPTION OF THE INVENTION

The invention first relates to a device, for example of the MEMS and/or NEMS type, for generating acoustic energy, or the cMUT type, including:

- at least one first deformable cavity made in a first substrate, called plane of the sensor, this cavity being delimited by at least one mobile or deformable wall or membrane, and by a means, for transmitting at least one pressure or depression or partial vacuum pulse, produced in the first cavity, at an ambient atmosphere, or a means for making the first cavity communicate with an ambient atmosphere, a means for actuating a displacement or deformation, in the plane of the sensor, of said mobile or deformable wall or membrane.

The invention therefore relates to a generator structure, for example of the MEMS and/or NEMS type, where a mobile or deformable wall or membrane moves in the plane of a substrate, and not out of plane as in the structures known from the state of the art.

According to the invention, the actuating or excitation part, for example of the capacitive or thermal excitation type, is decorrelated from the mobile or deformable wall or membrane. It is therefore possible to optimize these two parts separately. It is therefore possible to implement two or more device structures according to the invention, each having an actuator adapted to the stiffness of its mobile or deformable wall.

The actuating means can be used to actuate a displacement or deformation of the mobile or deformable wall or membrane in both directions (pressure and vacuum).

A device according to the invention can also include at least one secondary cavity, or buffer cavity, partially in communication with the first cavity.

Irrespective of the pressure in the first cavity and the position of the mobile or deformable wall, the first cavity is not in "direct" communication with the second cavity, but an "indirect" communication nevertheless exists, for example via one or several spaces ("gaps") between the first and the second substrate and/or between the first substrate and a third substrate, for example again at certain edges of the wall or the deformable membrane. This second cavity makes it possible to prevent excessive damping of a movement or displacement of the pressure generating means in the plane of the sensor, when the wall (or the membrane) is actuated. More particularly, the "gap" can be a small space between the mobile part and the stationary part. It is for example located between the substrate and the mobile or deformable part, or between the mobile or deformable part and the upper substrate. Aside from its impedance loss function, this space allows the mobile or deformable part to move in the plane.

Here again, this second cavity, forming what is called a "back-volume," can be optimized separately from the part forming the activation or excitation means. This second cavity makes it possible to limit the damping of the mobile or deformable wall or membrane by limiting the gas compression effect in this "back-volume," compression that would limit the effectiveness of the pressure generator. The aim is in fact to create an overpressure (or depression or partial vacuum) in the first cavity, but not outside that cavity (in particular not in the "back-volume").

At least one secondary cavity can be made in the plane of a second substrate different from the first substrate, or can be made in the plane of the first substrate.

If the secondary cavity is made in the plane of a second substrate, different from the first substrate, then:

the second substrate can also include the means to transmit at least one pressure or vacuum pulse, and/or the means to make the first cavity communicate with an ambient atmosphere; in other words, the second cavity and the means to have at least one pressure or vacuum pulse transmitted to an ambient atmosphere, or to make the first cavity communicate with an ambient atmosphere, can be made in a same second substrate, which can be assembled with the first; in that case, it is preferably closed, its closing being able to be done by a membrane, or the second substrate can be arranged on one side of the first substrate, a third substrate being arranged on another side of the first substrate, this third substrate including the means to make the first cavity communicate with an ambient atmosphere and/or the means to transmit at least one pressure or depression or partial vacuum pulse, produced in the first cavity, to an ambient atmosphere. In other words, alternatively, the second substrate is arranged on one side of the first substrate, a third substrate being arranged on another side of the first substrate, this third substrate having the means to transmit at least one pressure or depression or partial vacuum pulse or to make the first cavity communicate with an ambient atmosphere. The first substrate can then be arranged between the second substrate and the third substrate.

The at least second cavity can be open or closed, it can be made on the top or bottom side of the device, but it is not open, or does not communicate with the ambient atmosphere, on the same side as the first cavity. If it is closed, its closing can be done by a flexible membrane. In the event this second cavity is closed, its volume is preferably substantial enough to fully play the role of "back-volume" (typically its volume is then 10 times larger than the volume of the first cavity). In this case, this second (closed) cavity can be located on one or the other side of the first cavity or the first substrate in which said first cavity is made.

The invention makes it possible to monitor the rising edge and falling edge of the mobile or deformable wall or membrane, both for the pressure pulses and the vacuum pulses.

The actuating means can include capacitive-type means or thermal excitation-type means, for example by bimorph or asymmetrical effect.

When the actuation is done electrostatically, by surface variation, or in the case of actuation by thermal effect, the invention resolves the problem of the deformation amplitude of the nonlinear membrane as a function of the applied voltage. This also contributes to an effective monitoring of the rising and falling edge of each pressure or depression or partial vacuum pulse.

Having a capacitive means as actuating means makes it possible to have a good response linearity (for example measured by the ratio between the voltage applied to the actuating means and the displacement amplitude of the membrane) and therefore to be able to easily monitor the shape of a pressure pulse caused in the cavity.

Capacitive means can be provided with at least one first set of electrostatic combs, itself comprising a first comb, mobile in the plane of the sensor, and a second comb, stationary, the teeth of the first comb and those of the second comb alternating, and means for applying an activation voltage to move the mobile comb relative to the stationary comb.

A device according to the invention can include a first activation means, and a second activation means, arranged on either side of the first deformable cavity in the plane of the first substrate. These two sets of means make it possible to actuate the mobile or deformable wall in two opposite directions.

In another embodiment of the invention, the means for actuating a displacement or deformation of the mobile or deformable wall includes:

a means for creating at least a first force in a first direction substantially perpendicular to said wall, a means for creating at least a second force in a second direction substantially perpendicular to the first direction, and a means for converting said second force into a force along said first direction.

In other words, a device according to the invention can include several actuating assemblies arranged in the plane of the device around the deformable cavity. It is thus possible to achieve activations of the mobile or deformable wall(s) according to more complex schemes, for example an actuating assembly operating in compression of the deformable cavity, while another actuating assembly operates in depression or partial vacuum of the deformable cavity.

Thus, in the case of a capacitive actuation, a device according to the invention can include:

a second set of capacitive combs, the first set of capacitive combs and the second set of capacitive combs being arranged on either side of the first deformable cavity in the plane of the first substrate (100), and each including a comb able to move in a first direction, and at least a third set of capacitive combs, also in the plane of the first substrate, whereof one mobile comb is able to move in a direction perpendicular to the first direction.

A device according to the invention can include several first deformable cavities, at least two of these cavities having shared activation means.

The means for transmitting at least one pressure or depression or partial vacuum pulse, produced in the first cavity, at ambient atmosphere, or to make the first cavity communicate with an ambient atmosphere, can include a single opening for each deformable cavity, for example arranged opposite each deformable cavity, or a membrane arranged on, or opposite, said deformable cavity.

According to one preferred embodiment, at least one mobile or deformable wall includes two lateral ends, and is embedded or fastened at its two lateral ends. Alternatively, it is rigid, and maintained at its two lateral ends by deformable elements.

A device according to the invention can also include a means forming an electric contact, on a first face (called front face) or on a second face (called rear face).

The invention also relates to a method for making a device, for example of the MEMS and/or NEMS type, for generating acoustic energy, including:

the production, in a first substrate defining a plane, called plane of the device, of at least one first deformable cavity for receiving an ambient atmosphere, delimited by at least one mobile or deformable wall, the production of a means for activating a displacement or a deformation of said mobile or deformable wall in the plane of the device, the production of a means for transmitting at least one pressure or depression or partial vacuum pulse, produced in the first cavity, to an ambient atmosphere or for making the first cavity communicate with an ambient atmosphere.

A method according to the invention can also include the production, at least partly in a second substrate, of at least one secondary cavity, called "back volume" or buffer cavity, partially in communication with the first cavity.

At least one secondary cavity can be made in the plane of a second substrate, different from the first substrate, as already explained above.

The first substrate and the second substrate can be assembled via a dielectric layer to form a SOI substrate.

A method according to the invention can include an assembly of the first substrate with a third substrate. The means for transmitting at least one pressure or depression or partial vacuum pulse, produced in the first cavity, to an ambient atmosphere or to make the first cavity communicate with an ambient atmosphere, can be made therein.

Preferably, the excitation means (or detection means) is made at least partially in the first substrate.

The invention makes it possible to produce an original loudspeaker structure, or digital loudspeaker or cMUT structure, where the actuator means that generates the pressure pulses (or "speaklet") no longer moves outside the plane of the substrate, but in the plane. This configuration has many advantages, the most important of which are the possibility of generating both pressure and depression or partial vacuum pulses (case of the loudspeaker), and with similar actuating means for generating pressure or a depression or partial vacuum, which makes it possible to have a same pressure or depression or partial vacuum level, or to be able to generate high pressure levels (case of cMUTs).

The invention offers several other particular advantages:

the pressure caused in the cavity allows a displacement of the entire structure (which is not the case for an embedded membrane). Indeed, in the state of the art, the pressure is generated by a membrane embedded over its entire circumference. In the vicinity of this embedment, the membrane practically does not deform and therefore does not really participate in the generation of pressure. In this invention, the beam or the wall is only embedded at its two ends. A greater fraction of this deformable element consequently contributes to the generation of pressure. Effectiveness is therefore gained, with an equivalent membrane surface. The invention therefore makes it possible to increase the pressure pulse generating effectiveness, the present invention prevents the risk of "pull-in." In the case of electrostatic excitation with surface variation, the displacement of the wall is proportional to the voltage between the armatures of the capacitive combs. Such a nonlinear effect, making the system unstable and able to cause adhesion of the structure and/or a short circuit of the electrostatic actuator, is prevented by the present invention.

BRIEF DESCRIPTION OF THE INVENTION

FIGS. 1A and 1B show aspects of devices of the prior art,

FIGS. 2A-4B show various embodiments of a device according to the invention, with actuating means of the capacitive type, FIG. 5 shows, in top view, another example of a device according to the invention, with several actuating means around the deformable cavity, FIG. 6 shows, in top view, another example of a device according to the invention, with actuating means by thermal excitation, FIGS. 7A and 7B show, in side view, cross-section, and top view, another example of a device according to the invention, with several parallel cavities, FIGS. 8A-8G show an example of an embodiment of a device according to the invention.

DETAILED DESCRIPTION OF THE INVENTION

Figure 1A:
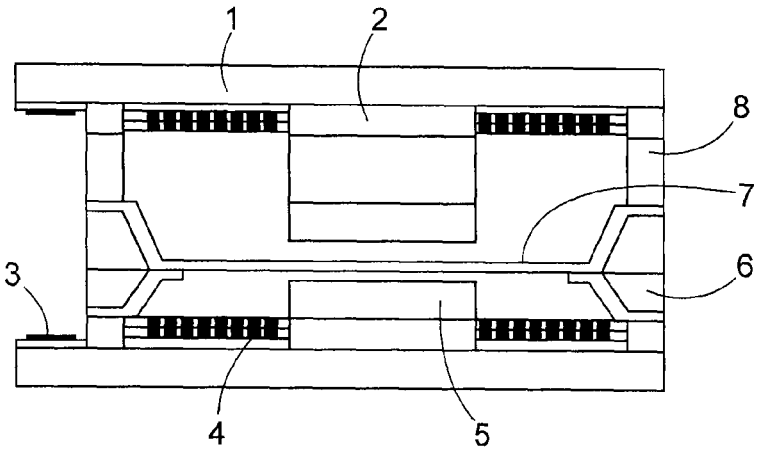
FIG.1A (PRIOR ART)
Figure 1B:
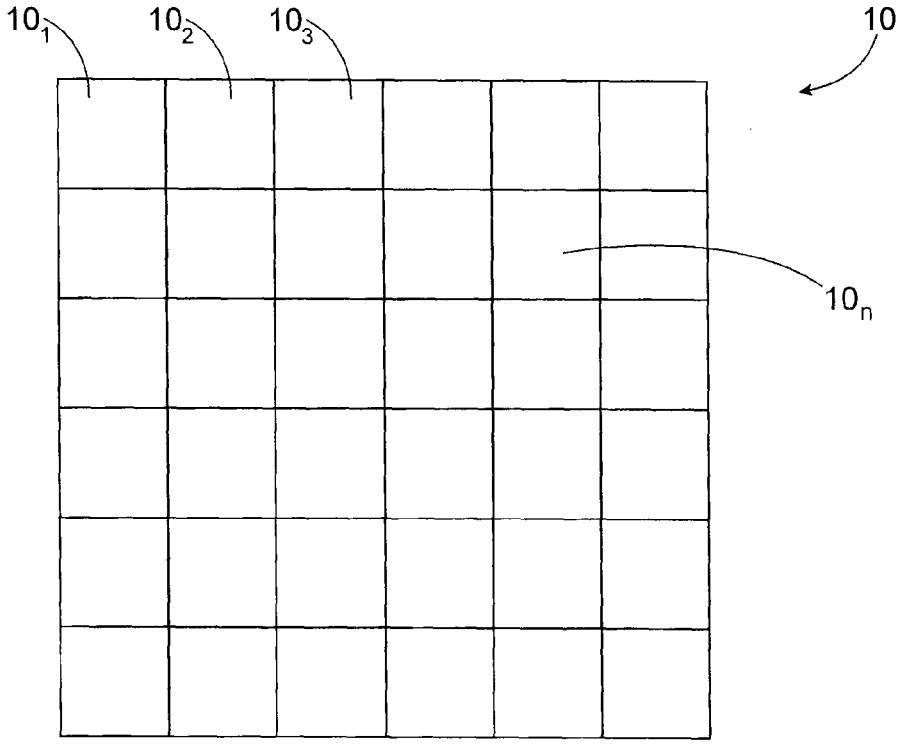
FIG.1B (PRIOR ART)
Figure 2A:
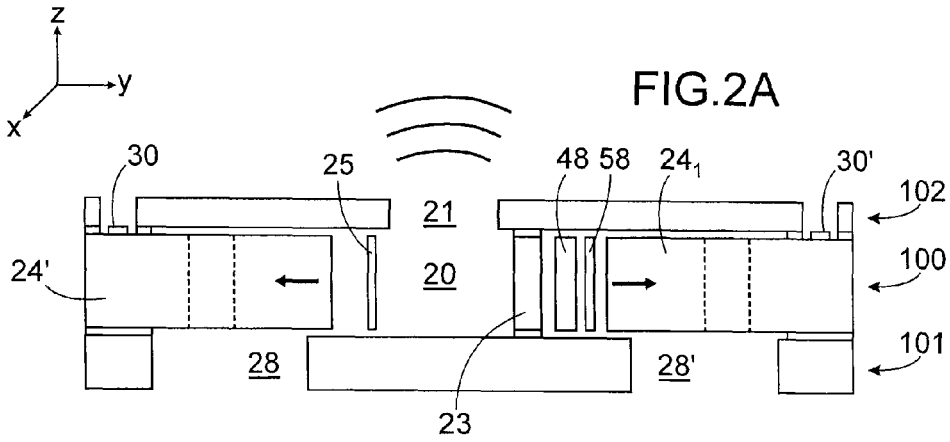
Figure 2B:
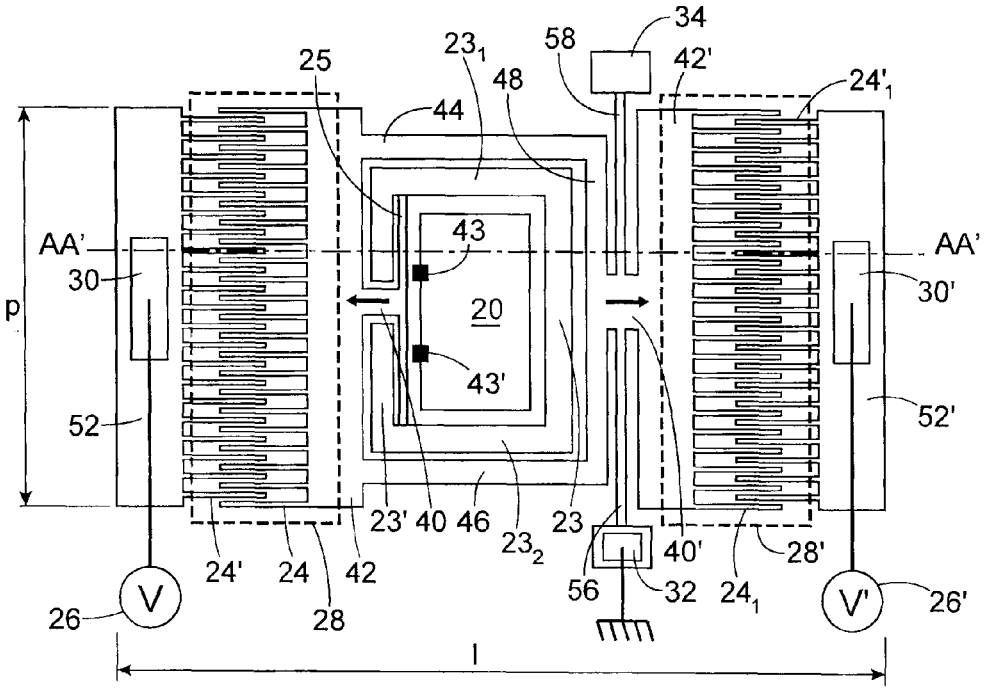

A first example of a structure according to the invention is illustrated in FIG. 2A, which is a cross-sectional view along a plane, the outline AA' of which is shown in FIG. 2B (top view). This structure makes it possible to generate pressure or depression or partial vacuum pulses.

Hereinafter, when we talk about "substrate" 100, 101, 102, this may also be understood as a "layer." As a result, for these three elements, both of these terms may be used interchangeably.

A structure according to the invention can be made in 2 or 3 substrates 100, 101, 102 (the case of FIG. 2A is with 3 substrates) superimposed and assembled with each other, the substrate 100 being arranged between the substrate 101 and the substrate 102. Each of the substrates 100, 102 has a thickness for example between several μm and several tens of μm, for example between 1 μm or 5 μm and 10 μm or 50 μm. The substrate 101 has a thickness for example between several tens of μm and several hundreds of μm, for example between 100 μm or 500 μm and 1000 μm, for example substantially close to 750 μm. These dimensions can be used for all of the devices described below.

Each of these substrates extends in a plane xy, the z axis being perpendicular to each of them. The thickness of each substrate, measured along this z axis, can, in certain cases, be small or very small before the lateral extensions of the device, i.e. before the dimensions p and l of the device measured in the plane xy; p (measured along the x axis) is for example between 100 μm and 1 mm and l (measured along the y axis) is for example in the vicinity of several hundreds of micrometers, for example between 100 μm and 500 μm or 1 mm. The substrates can each be made from a semiconductor material (for example made from Silicon or SiGe). They are connected to each other by adhesion zones, for example via one or several layers favoring adhesion, such as a layer of silicon oxide, at the interface of two substrates, except in the zones having a mobile nature as explained below. Hereafter, the plane xy will be called the plane of the device. This structure is found in the other embodiments presented below. These aspects of the invention may be used for all of the devices described below.

Hereafter, the lower part or side of the device is the part facing the substrate 101 and the upper part or side of the device is the part facing the opposite side, towards the substrate 102.

The device first includes a cavity 20, made in the substrate 100, including an opening in its upper part.

An opening 21, which communicates with that of the substrate 100, is also made in the substrate 102. It makes it possible to transmit, to the surrounding atmosphere, pressure or depression or partial vacuum pulses created in the cavity 20. Alternatively (examples of which will be shown below), this opening includes a plurality of orifices forming a grid, for example to limit the introduction of foreign items, such as dust, in the cavity 20. It can therefore also serve as a filter. Also alternatively, the cavity is closed by a flexible membrane, such as the membrane 281 shown in FIG. 7A.

In the plane of the substrate 100, the cavity 20 is delimited by side walls 23, $\mathbf{23}_1$, $\mathbf{23}_2$, 25, some of which (the walls 23, $\mathbf{23}_1$, $\mathbf{23}_2$) are stationary, and at least one other of which (here the wall or membrane 25) is mobile or deformable in the plane xy of the device. In the example shown in FIGS. 2A and 2B, the cavity 20 is rectangular in the plane of the device, but another shape can be made. A structure without the wall 23' of FIG. 2B, that the arm 40 passes through, can also be made in the context of the present invention. Under the effect of actuating means whereof embodiments will be described below, the mobile wall or membrane 25 will be displaced or deformed in plane xy. In the illustrated example, the ends of the mobile wall 25 are fastened to two stationary walls $\mathbf{23}_1$, $\mathbf{23}_2$, and it is therefore a deformation here of the mobile wall that will take place, under the effect of actuating means, via an arm 40 that passes through one of the stationary walls 23'.

The wall here is therefore of the "embedded-embedded" type, i.e. both of its lateral ends are embedded in a stationary part of the device. This wall can have approximately the following geometric characteristics:

- height (measured along the z axis): substantially equal to the thickness of the substrate 100, therefore between several tens of μm and several hundreds of μm; but in certain embodiments, it can be between several μm and several tens of μm (for example between 5 μm and 50 μm),
- width (measured along the y axis): for example, between 0.5 μm and 10 μm; this width is small enough for the wall 25 to have the desired sensitivity to actuation under the effect of the actuating means 24,
- length (measured along the x axis): for example between 100 μm and 1 mm.

The mobile wall, alternatively, can be of the type shown below, relative to FIGS. 4A and 4B: it then includes a rigid main part that moves under the effect of the pressure, and at least one or two lateral parts 253, 255 each forming a "spring," connected to the stationary and deformable part.

In this embodiment, as in the following embodiments, it is possible to use one or the other of the different types of deformable wall or membrane just presented or that will be presented in the continuation of this text.

Alternatively, several cavities can be made in the substrate 100, examples of which will be seen later.

The actuating means 24 is therefore stationary or connected or, more generally, associated with these mobile walls, this means here assuming the form of electrostatic excitation means, more specifically of capacitive combs.

These capacitive combs are arranged according to a particular configuration, which will be explained below, with a displacement of the mobile part of the combs along the y axis and along the extension direction of the teeth of the comb. But other configurations are possible, such as that of FIG. 10, with an extension direction of the teeth of the comb along the x axis (and a movement of the part of the comb along the y axis).

Here we have an electrostatic excitation with surface variation, but it is possible to make, alternatively, an electrostatic excitation with air gap variation. An example of this alternative is provided in FIG. 11, where the distribution of the gaps is done for example at ⅓-⅔: the gap between two teeth of the stationary comb is d, and, when idle, a tooth of a mobile comb is between two teeth of the stationary comb, the distance between a tooth of the mobile comb and one of these two teeth of the stationary comb is $d_1$ (equal to about ⅓ of the distance d) while the distance between the same tooth of the mobile comb and the other of these two teeth of the stationary comb is $d_2$ (equal to about ⅔ of the distance d). The teeth of the comb in this case are perpendicular to the direction of displacement of the deformable membrane or the piston. Also alternatively, this means can include a means operating by thermal effect, examples of which will also be shown below.

Regardless of the nature of the actuating means, actuation can be done by at least two sets of actuating means, arranged on either side of the cavity, as explained later. This is in particular the case when the cavity 20 includes 2 mobile or deformable walls or if one wishes to actuate the mobile wall in either direction (i.e. to be able to generate a pressure or depression or partial vacuum wave). The means 24 is activated by varying a physical parameter, which will make it possible to cause a variation in the volume of the cavity 20. It can therefore be associated with a means 26 that makes it possible to cause a variation of this physical parameter, here a voltage variation that results in a capacity variation and therefore a relative movement of the two combs. This results in a corresponding displacement or deformation of the wall 25 or the corresponding variation of the volume 20.

In this example, as in the examples below, the cavity 20 and the means 24 are made in the intermediate substrate 100.

A device according to the invention includes a stationary part, i.e. whereof the position does not evolve under the effect of the actuating means, and a mobile part, the position of which evolves or is modified under the effect of the actuating means. The mobile part is connected to the stationary part. A means (for example one or more arms such as the arms 56, 58) or the elasticity of the mobile or deformable wall 25 itself or the end parts 253, 255 of the wall (in the case of FIG. 4B) can make it possible to bring it back to its initial position relative to the latter when the actuating means return to their initial state (or are no longer powered).

The cavity 20 receives the displacements imposed by the actuating means. One side of the membrane or the wall 25 is in contact with the "average" ambient pressure, for example the atmospheric pressure. To that end, the device can include at least one lower secondary cavity 28, 28', made in the lower substrate 101. This cavity is open under the device. Alternatively, explained more precisely later, it is possible to make a closed secondary cavity above or below the device, but then preferably voluminous enough (its volume can then be at least several times the volume of the cavity 20, for example at least 5 times the volume thereof, for example 10 times the volume of that cavity 20) to allow the mobile or deformable wall or membrane to move under the effect of the actuating means without excessive damping.

Figure 2C:
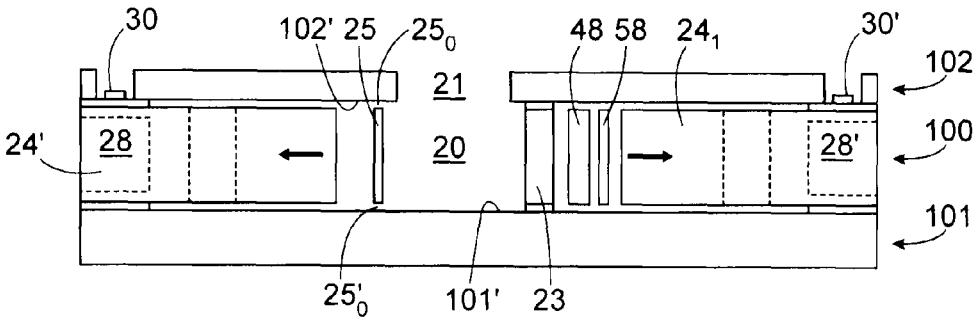
Figure 12A:
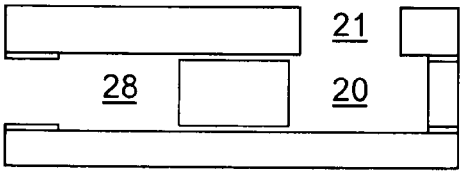
FIGS. 12A and 12B show an alternative of a secondary cavity (or "back volume") of a device according to the invention.
Figure 12B:
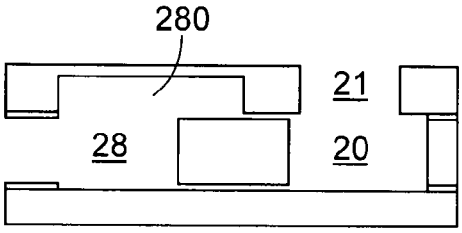

According to still another alternative, one or several secondary cavities 28, 28' can be open (or may be closed) on the side, for example at least one cavity of this type is made in the intermediate substrate 100. Examples of lateral cavities are illustrated in FIGS. 2C, 12A-12B.

Irrespective of its shape and position in the device, this secondary cavity is also designated by the expression "back volume." It is situated, in FIGS. 2A and 2B, and in most of the other illustrated embodiments, in a plane or substrate 101 (or 102) different from that of the cavity 20 and means 24. However, in the case of FIGS. 2C, 16A-16B, it is made in the same substrate as that of the main cavity 20.

In the present example, this secondary cavity is offset, in its own plane relative to the cavity 20. In other words, there is no intersection between the projection, in the plane of the substrate 101, of the main cavity 20, and the contour of the secondary cavity 28.

But there is also a communication between these two cavities, or, more generally, between the main cavities and at least one of the secondary cavities, because a space, which can be fairly small, is maintained between the upper part $\mathbf{25}_0$ and/or the lower part $\mathbf{25'}_0$ of the wall 25, and the upper surface 101' of the substrate 101 and the lower surface 102' of the substrate 102. A leak is thus ensured between the two cavities 20 and 28. In this way, and irrespective of the state or position of the activation means and the position of the mobile wall, the cavity 20, which is in communication with the outside atmosphere via the opening 21, is also in communication with any one of the secondary cavities 28, 28'. One or more of these secondary cavities makes it possible to reduce the compression effects of the gas during a displacement of the membrane, which is advantageous, since such a compression tends to decrease the sensitivity of the device. These cavities can also be called damping cavities.

The deformable cavity 20, and the secondary or damping cavity or cavities 28, 28' are therefore partially in communication and partially separated at least by the wall or membrane 25, which itself is able to move (or deform) in the plane of the substrate under the effect of the actuating means.

The device also includes contact zones 30, 30', 32. These contact zones make it possible to connect means 26, 26' to activate the actuating means, and therefore to apply a suitable voltage variation, adapted to cause a depression or partial vacuum or pressure in the cavity 20. Here, in the example of actuating means in the form of electrostatic combs, a voltage variation by the means 26, 26' will cause a displacement of the comb.

In the illustrated example, the contacts are arranged on the front face of the device, i.e. it is possible to access them through, or they can be made in, openings formed in the substrate 102. However, alternatively, it is also possible to make contacts on the rear face, as will be seen in examples below.

We will now provide a slightly more detailed description of the structure of the capacitive combs 24 used as actuating means for the embodiment presented above.

A first comb is connected to the mobile wall 25 via an arm 40 that extends substantially along the y axis. When the mobile comb 24 is moved in the direction indicated in FIG. 2B (and in fact also along direction y), due to a variation of the voltage V applied by the means 26, the wall 25 is pulled by the arm 40, which itself is pulled by the comb. It can be noted here that the component is used as an actuator and not as a sensor. The supply voltage of the actuator is therefore adapted to prevent excessive displacements of the wall or the membrane 25. It is nevertheless possible to have stops 43, 43' to limit the displacement of this wall or membrane 25 or to absorb impacts on the device; alternatively it is possible, to perform the same functions, to use the wall 23' as a stop.

The comb 24 has teeth that are parallel to each other, each tooth extending in plane zy. These teeth are made in the substrate 100. They are all fastened to an arm 42, arranged substantially perpendicular to pane zy, therefore rather along the x axis and perpendicular to the arm 40. An alternative with air gap variation capacitive actuation is described later. A stationary part 52 of the device, also made in the form of an arm substantially parallel to the arm 42, is also fastened or connected to a comb 24', which itself also has a row of teeth that are parallel to each other, each of them also being arranged in a plane in direction zy. These teeth of the stationary part are also made in the substrate 100.

The teeth of the two rows of teeth of the combs 24, 24' are alternating, in that part of each tooth (except potentially the teeth located at the end of a row of teeth) of the comb 24 is arranged between two adjacent teeth of the comb 24'. And part of each tooth (except potentially the teeth located at the end of a row of teeth) of the comb 24' is arranged between two adjacent teeth of the comb 24.

Each tooth can have a thickness, measured along the x axis, between 2 μm or 5 μm and 10 μm or 100 μm. Two adjacent teeth of a same comb are separated by a distance that can be between 0.5 μm or 1 μm and 3 μm or 10 μm.

The teeth of the two combs are electrically conductive.

When the device is idle and when a suitable voltage difference is established between the two rows of teeth, a set of parallel capacitances is made. Varying the voltage V causes the teeth of the mobile comb 24 to move relative to the teeth of the stationary comb 24', for example in the direction indicated by the arrow in FIG. 2B, and therefore a displacement of the arm 40, which causes a displacement or deformation of the wall 25.

The embodiment of FIG. 2B shows that the arm 42 in fact makes up one of the sides of a frame including three other arms or sides 44, 46, 48 that surround the walls 23, $\mathbf{23}_1$, $\mathbf{23}_2$, 25 delimiting the cavity 20. It is therefore this entire frame that is made to move when the mobile comb 24 is displaced due to a variation of the voltage V. The side or the arm 48, opposite the arm 42, can also be connected, by an arm 40', oriented along the y axis, to a mobile comb $\mathbf{24}_1$, which can therefore also be displaced, for example in the direction opposite that of the arm 40, when the voltage V' applied to that mobile comb $\mathbf{24}_1$ is varied. The comb $\mathbf{24}_1$ is also made in the substrate 100. Its teeth are all fastened to an arm 42', arranged substantially perpendicular to the plane zy, therefore rather along the x axis and perpendicular to the arm 40'.

Lastly, associated with this comb $\mathbf{24}_1$ is a stationary comb $\mathbf{24'}_1$, the teeth of which are fastened to a stationary part 52' of the device and with which it cooperates in the same way the mobile comb 24 cooperates with the stationary comb 24'. The alternating relative arrangement of the teeth of these two combs $\mathbf{24}_1$, $\mathbf{24'}_1$ is similar or identical to what was already described above for the two combs 24, 24'. The stationary part 52' is also made in the form of an arm substantially parallel to the arm 42'. Fastened or connected to this stationary part 52' are the teeth of the comb 24', arranged in a row of teeth parallel to each other, each also being arranged in a plane in direction zy. The arm 52' and the teeth of the stationary comb $\mathbf{24'}_1$ are also made in the substrate 100.

Each tooth of each comb $\mathbf{24}_1$, $\mathbf{24'}_1$ can have a thickness, measured along the x axis, between 2 μm or 5 μm and 10 μm or 100 μm. Two adjacent teeth of a same comb are separated by a distance that can be between 0.5 μm or 1 μm and 3 μm or 10 μm.

The teeth of the two combs $\mathbf{24}_1$, $\mathbf{24'}_1$ are electrically conductive.

When the device is idle and when a suitable non-zero difference in the voltage V' is established between the two rows of teeth of the two combs $\mathbf{24}_1$, $\mathbf{24'}_1$, a set of parallel capacitances is made, the two combs assuming an equilibrium position relative to each other as a function of the value of the voltage V'.

A variation of the voltage V' causes a displacement of the teeth of the mobile comb $\mathbf{24}_1$ relative to the teeth of the stationary comb $\mathbf{24'}_1$, for example in the direction indicated by the arrow in FIG. 2B, therefore a displacement of the arm 40', which causes, via the arms 40, 42, 44, 46, 48, 40', a displacement or deformation of the wall 25.

This device can also include a guide means 56, 58, in plane xy in which the membrane of the mobile or deformable wall as well as the detection means move.

This means here assumes the form of at least one arm 56, 58, for example two arms, each arranged substantially in direction x, in plane xz, but with a width (which can be between 1 μm and 10 μm), in direction y, small enough to allow each of the arms to have, in that same direction x, sufficient flexibility during a movement that results from a displacement of the wall 25.

The arm 56 can be arranged, as illustrated in FIG. 2A, between the side 48 of the mobile frame formed around the cavity 20, and the arm 42' of the second mobile comb $\mathbf{24}_1$. Being mechanically connected to the stationary part of the device, it makes it possible to guide the displacement of the mobile part in the plane of the substrate 100 and to bring that mobile part back to its starting position after the activation means return to their initial state, before excitation. A second arm 58, which can be symmetrical to the arm 56 relative to an axis parallel to the y axis, and also connected to a stationary part 34 of the device, also makes it possible to perform this function of guiding the mobile part. The arm 58 can have the same geometric and elasticity characteristics as the arm 56.

Furthermore, a means makes it possible to apply the suitable voltage to the mobile part of the device to allow each of the electrostatic combs to play its role.

This means for applying a voltage can use, or be combined with, at least one of the arms 56, 58. For example, the arm 56 is itself mechanically and electrically connected to one of the contact studs 32 to which the desired voltage can be applied. Studs 30, 30' are also provided in other stationary parts of the device, for example in parts 52, 52'.

When the device includes, as described above, two systems of combs on each side of the device, one of the mobile combs can be used to cause a pressure pulse in the cavity 20, while the other mobile comb can be used to cause a depression or partial vacuum pulse in that same cavity 20. Under the effect of one and/or the other of the supply voltages V, V', one and/or the other of the actuators creates a force in the plane of the substrate. The resulting force pushes or pulls the membrane 25. The displacement of that membrane creates a pressure (or depression or partial vacuum) pulse in the upper cavity 20 that is discharged via the upper vent 21.

The comb means, the arms 42, 44, 46, 48 forming the frame around the walls of the cavity 20, the arms 40, 40', are formed in the same substrate 100.

The example described above can also include only a single system of combs.

Other examples of a device according to the invention will be presented below.

Figure 3:
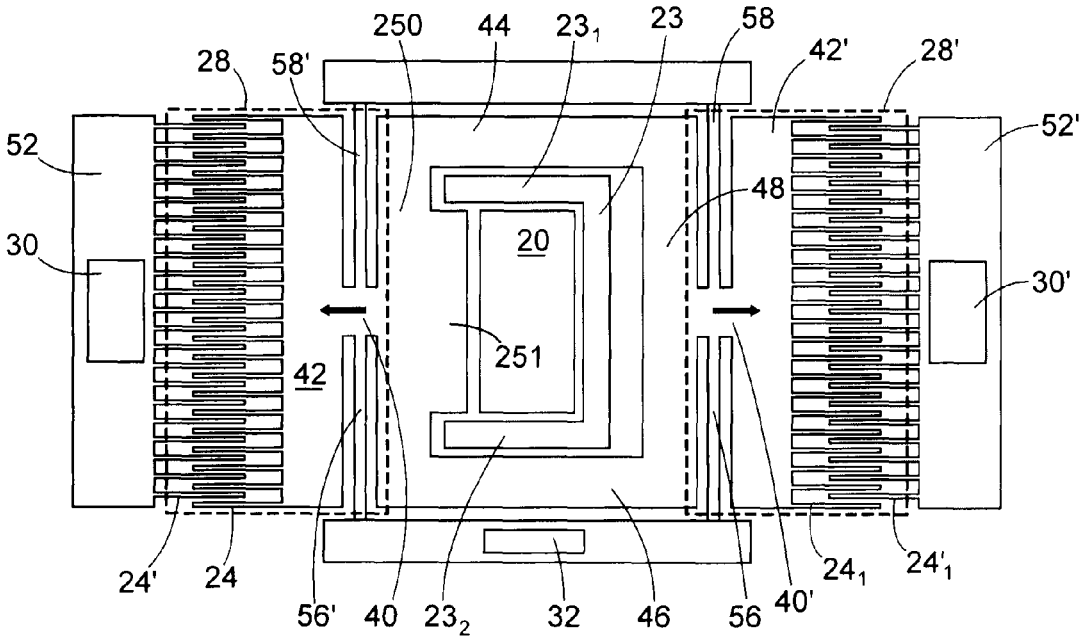

According to a second example shown in FIG. 3, the wall 25 is replaced by a wall 250 that is not deformable but can be translated along the y axis. This wall can also include a projection 251 forming a piston cooperating with the stationary walls 23, $\mathbf{23}_1$, $\mathbf{23}_2$ to generate the desired pressure variation. More precisely, this projection 251 can penetrate the volume 20, thereby generating a compression of the atmosphere present therein.

The contacts are, here again, on the top of, on or in the substrate 102.

The actuating means is the same as in the preceding example. The device therefore operates in the same way as already described above. Actuating the second system of combs also acts on the mobile frame via the side 48 and sides 44, 46, and therefore on the wall 250 and the piston 251. This embodiment can also work with a single system of combs.

A third embodiment is shown in side and top views in FIGS. 4A and 4B. FIG. 4A is a cross-sectional view along a plane, the outline $A_1A'_1$ of which is visible in FIG. 4B (top view).

A difference relative to FIGS. 2A-2B lies in the contacts $\mathbf{30}_1$, $\mathbf{30'}_1$, $\mathbf{32}_1$, which here are on the rear face, i.e. on or in the substrate 101. Another difference lies in the structure of the wall 25.

The structure of the wall 25 is of the type having a rigid central part framed by two parts 253, 255 forming a "spring," and which are deformable. Under the effect of the actuating means, the rigid part moves, the parts 253, 255 being deformed. These parts also return the rigid part to the initial position when the actuating means returns to its initial state, after excitation. These parts 253, 255 form spring connections at the ends of the rigid part. Here there is a so-called "piston" effect or movement of the mobile part. But it would also be possible to use, in this embodiment, the deformable membrane or wall form presented above in connection with the preceding figures.

The advantage of a "piston" structure (as shown in FIG. 3 or in FIGS. 4A-4B) relative to a "deformable wall" (as shown in FIGS. 2A-2C) is that the volume of air the "piston" structure makes it possible to displace is more significant for a displacement amplitude of the wall. However, in the case of FIG. 3, there is an impedance loss at the ends of the piston 251 that is not present on the piston 25 of FIG. 4, due to the portions 253, 255 forming a spring in this figure.

The actuating means are the same as in the previous example. Guide arms 56, 58 are arranged here in the mobile frame, which makes it possible to guide the movement of the assembly formed by the mobile wall, the frame, and the combs, like the arms 56 and 58 of FIG. 2B. Placing them inside the frame makes it possible to gain compactness. This alternative is allowed here due to a taking up of the electrical contacts on the rear face (in particular the contact $\mathbf{32}_1$). This was not the case in FIGS. 2A-2C.

A fourth example (FIG. 5, top view) uses a capacitive excitation applied to two deformable members 25, 25'.

The structure of the cavity 20 is different from that presented above, because it includes two mobile or deformable walls 25, 25', both of which are arranged so as to be able to move or deform along the y axis.

The ends of each of the mobile walls 25, 25' are fastened to two parallel stationary walls $\mathbf{23}_1$, $\mathbf{23}_2$ and it is therefore a deformation of the mobile walls that will occur. Each of these mobile walls has a thickness, measured along the y axis, small enough to have the desired sensitivity to the movements caused by the actuating means in the plane of the device.

The cavity therefore has a stationary wall 23" parallel to the wall 23' and perpendicular to the walls $\mathbf{23}_1$, $\mathbf{23}_2$, this wall 23" also being pierced with an opening allowing the passage of an arm 40' connecting the second mobile wall 25 and at least one second set of combs $\mathbf{24}_1$, $\mathbf{24'}_1$, one of which is mobile and the other of which is stationary. A device without the walls 23', 23" can generally be done in the context of the invention, the cavity being closed by the walls 23, 25' and the stationary walls $\mathbf{23}_1$, $\mathbf{23}_2$. In this way, the two arms 40, 40' move along the same y axis, as a function of the voltages applied to their respective sets of combs.

If the voltage supply means 26, 26' apply the same voltage to both systems of combs, then the two walls 25, 25' move away from each other.

Figure 5:
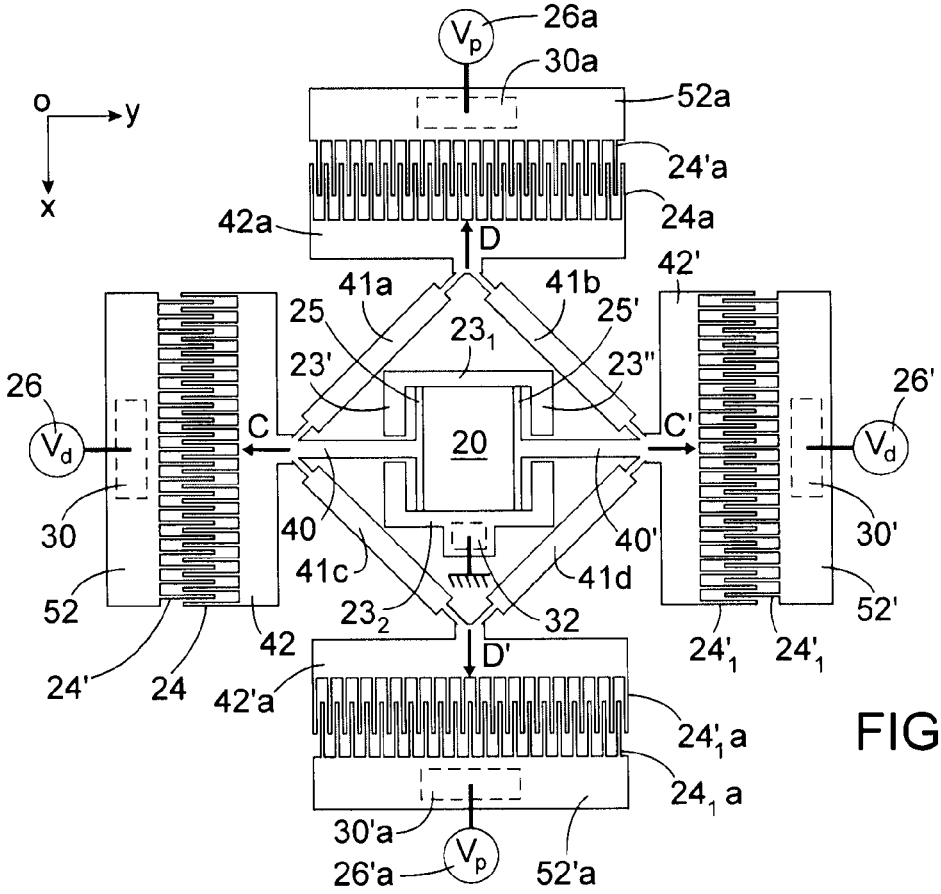

Such a device can also be made and operate with only one of the two sets of combs 24, 24' or $\mathbf{24}_1$, $\mathbf{24'}_1$ (and only one deformable wall), but less efficiently than with the two sets of combs 24, 24' and $\mathbf{24}_1$, $\mathbf{24'}_1$ of FIG. 5. In this example, the device also includes two additional sets of combs, each having displacements along the x axis. Each includes, as in the examples of combs already described above, a stationary comb 24'*a*, $\mathbf{24}_1$*a* and a mobile comb $\mathbf{24'}_1$*a*, 24*a*, the teeth of one alternating with the teeth of the other. Each stationary comb connected to a stationary part 52*a*, 52'*a* of the device, including a means 30*a*, 30*a'* forming a connection means for a voltage supply means 26*a*, 26'*a*.

Such a device can also be made and operate with only one of the two additional sets of combs 24*a*, 24'*a* or $\mathbf{24}_1$*a*, $\mathbf{24'}_1$*a* but less efficiently than with the two sets of additional combs 24*a*, 24'*a* or $\mathbf{24}_1$*a*, $\mathbf{24'}_1$*a* of FIG. 5.

Each of these two sets of additional combs is arranged so that its teeth are aligned in plane zx, and so that a movement of the mobile comb occurs along the x axis.

The two sets of additional combs can therefore be obtained by a 90° rotation around the z axis of the two sets of combs 24, 24', $\mathbf{24}_1$, $\mathbf{24'}_1$.

The device also includes a connecting lug connected to its stationary part, here near the stationary walls 23 that delimit the cavity 20.

Specific coupling means 41*a*, 41*b*, 41*c*, 41*d* are also provided to connect the two sets of additional combs and the mobile walls 25, 25'.

More specifically, for each additional mobile comb 24*a*, $\mathbf{24'}_1$*a*, a set of two arms is provided, arms 41*a*, 41*b* for mobile comb 24*a* and arms 41*c*, 41*d* for mobile comb $\mathbf{24'}_1$*a*.

Each of the arms 41*a*, 41*b* connects the mobile comb 24*a*, for example the middle point D of the arm 42*a*, and a zone of one of the arms 40, 40', for example:

- the end of the arm 40, opposite the wall 25 and arranged near or on the arm 42 of the mobile comb 24, at the middle point C of the arm or near that point,
- and the end of the arm 40', opposite the wall 25' and arranged near or on the arm 42' of the mobile comb $\mathbf{24}_1$ at the middle point C' of the arm 42' or near that point.

Each of the arms 41*c*, 41*d* connects the mobile comb $\mathbf{24'}_1$*a*, for example the middle point D' of the arm 42'*a*, and a zone of one of the arms 40, 40', for example here again:

- the end of the arm 40, opposite the wall and arranged near or on the arm 42 of the mobile comb 24, at the middle point C of the arm 42 or near that point,
- and the end of the arm 40', opposite the wall 25' and arranged near or on the arm 42' of the mobile comb $\mathbf{24}_1$ at the middle point C' of the arm 42' or near that point.

In other words, the four transmission arms 41*a*, 41*b*, 41*c*, 41*d* are slanted relative to the x and y axes (e.g. 45° relative to said axes), and connect points C and C', respectively located on the edges of the arms 42, 42', at points D and D', respectively situated at the edge of the arms 42*a*, 42'*a*.

These four transmission arms substantially form a diamond. Advantageously, when idle, the distance between points D and D' is identical to the distance between points C and C', the transmission arms thus forming a square.

When one applies, via the means 26*a*, 26'*a*, voltages that make it possible to apply a movement to the mobile combs 24*a*, $\mathbf{24'}_1$*a* in the plane of the device, along the x axis, tending to move these combs away from the cavity 20, then the combined action of the arms 41*a*, 41*b*, 41*c*, 41*d* and the arms 40, 40' tends to bring the walls 25, 25' back towards the center of the cavity 20, along the y axis (because the length of the arms 41*d*, 41*b* remains constant).

Preferably, a voltage is applied via a means 26*a*, 26'*a* tending to create a pressure pulse in the cavity 20, while a voltage is applied to the means 26, 26' tending to apply a depression or partial vacuum pulse in the cavity 20.

In this embodiment, as in the preceding ones, the cavity 20, its walls, and the actuating means, here including a set of four pairs of combs, are made in the intermediate substrate 100.

The structure with two deformable membranes 25, 25' can be implemented in the context of an alternative embodiment of FIG. 2B, i.e. with only two sets of combs as illustrated in that figure. However, in this case, it is only possible to actuate the membranes to generate depression or partial vacuum pulses.

Figure 6:
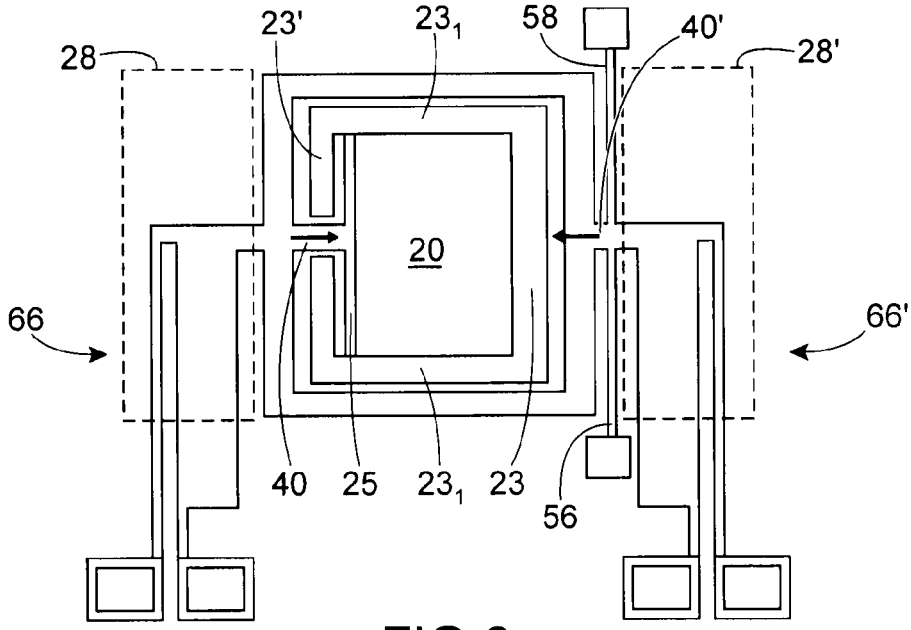

A fifth embodiment, illustrated in FIG. 6 in top view, includes means for producing a thermal excitation (through bimorph or asymmetrical effect) applied to a deformable membrane. This means is for example of the thermal actuator or piezoelectric type. The structure of this means and its operation is for example described in the article "Time and frequency response of two-arm micromachined thermal actuators R Hickey et al-2003 J. Micromech. Microeng. 13-40." Information regarding the operation of the bimorphic actuator is available at: http://www.pi-france.fr/PI%20Universite/Page20%20.htm. In summary, a constraint in the plane of one of the layers of a multi-layer stack (if there are two, it is called a bimorph) causes a displacement of this stack in the direction perpendicular to the plane of the layers.

Two sets of means for producing a thermal excitation are shown in FIG. 6, but there can be only one, in which case there is actuation in only one direction (either pressure or depression or partial vacuum).

Figure 7A:
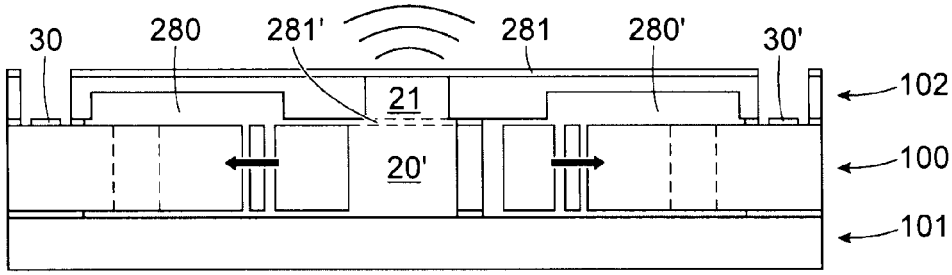
Figure 7B:
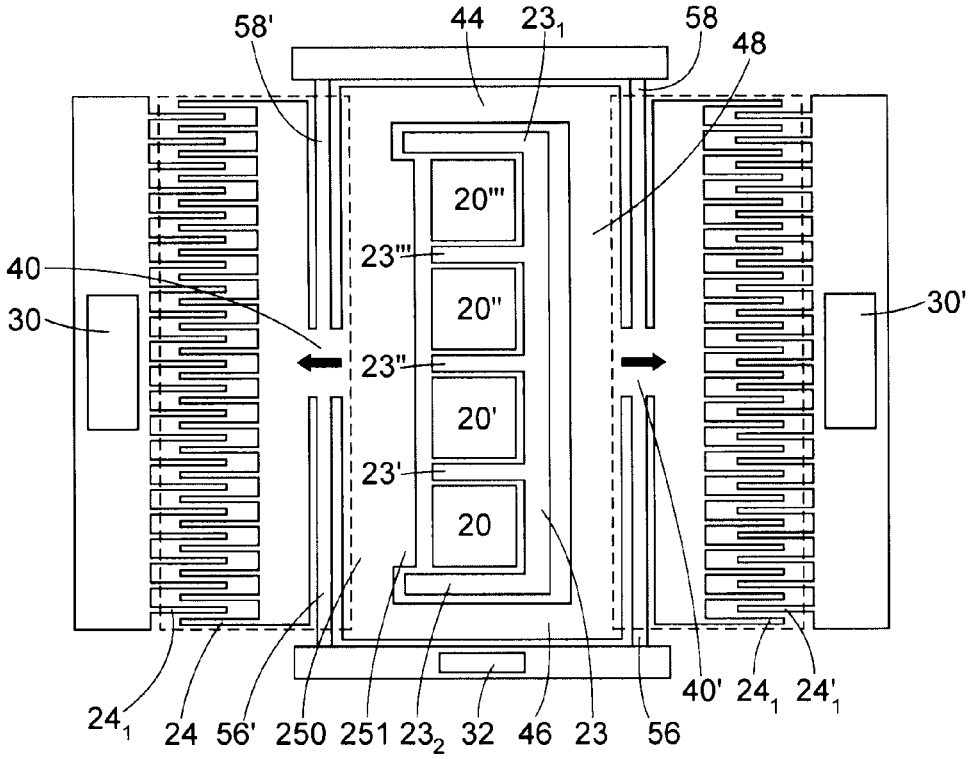

A sixth embodiment is shown in FIGS. 7A (cross-sectional side view) and 7B (top view).

It includes a means for producing an electrostatic actuation, of the flat piston type, on several parallel cavities 20, 20', 20", 20'" (in particular for cMUT). These cavities, or their corresponding openings 21, can be closed by a flexible membrane 281, which for example makes it possible to prevent dust or moisture from entering the device in the case of a loudspeaker-type operation. In the case of cMUT operation, this membrane can also vacuum seal or partially vacuum seal the device (a cMUT working at the resonance). It can be noted that this membrane 281 can also be arranged on the other face of the substrate 102 as illustrated by the membrane 281' in broken lines in FIG. 7A. This closing system of the cavity 21 can also be implemented in the context of the preceding embodiments.

This device also includes two cavities 280, 280', each forming a "back volume," which is closed and placed on the top side of the component, in the substrate 102. These two aspects, flexible membrane closing one or more cavities or the corresponding openings 21, and a cavity forming a "back volume," which is closed and placed on the top side of the component, can be applied to the other embodiments of the present invention.

In this embodiment, we see the structure of FIG. 3, with its piston 251 but, this time, not one cavity 20, but four cavities 20', 20", 20'" arranged in parallel, next to each other, in direction x, i.e. perpendicular to the movement of the mobile combs 24, $\mathbf{24}_1$. Two adjacent cavities can have a shared side wall. In this way, cavities 20 and 20' share wall 23', cavities 20' and 20" share wall 23", cavities 20" and 20'" share wall 23'". Each cavity has an opening facing the piston 251, the latter part gradually closing or opening all of the cavities at the same time. A single wall 23 delimits the cavities on the side opposite their openings and the piston 250.

A second pair of arms 56', 58' is added to the ends guiding the movement of the frame.

In the event this type of component is used for cMUT applications, the interdigital combs serve both to generate ultrasound waves (operating in transmission, as previously described), but also for detecting reflected ultrasound waves (operating in reception) serving for the analysis. In the case of a cMUT, at the resonance frequency of the structure is about several MHz, for example between 1 MHz and 10 MHz. For cMUT applications, the cavities 20, 280 are vacuum or partially vacuum sealed (via the membrane 281).

Figure 10:
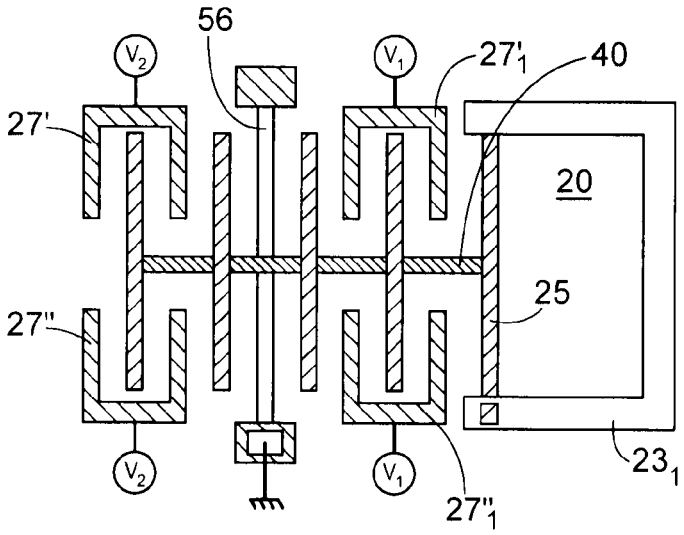
FIGS. 10 and 11 show, in top view, other embodiments of a device according to the invention.

FIG. 10 shows still another embodiment, in which the activation means, again of the capacitive type, are made by a system of combs, the teeth of which are, this time, oriented along the x axis, not along the y axis as in FIGS. 2A-2B. An arm 40, substantially perpendicular to the wall 25, supports the teeth of the mobile part of the comb 27, two stationary parts 27', 27" of the comb being arranged, relative to each row of teeth, as already explained above in relation to FIG. 2B.

According to one alternative of this embodiment, the stationary parts are lined, with stationary parts 27', 27" and $\mathbf{27'}_1$, $\mathbf{27"}_1$, intended to receive different voltages $V_1$ and $V_2$. The guide arms 56, can be provided, for example between the means to which a voltage $V_1$ can be applied and those to which a voltage $V_2$ can be applied. Being able to apply two different voltages will make it possible to actuate, with one of them, the membrane in a direction, for example to the right, in compression of the cavity 20, and to actuate, with the other voltage, the membrane in another direction, for example to the left, in depression or partial vacuum of the cavity 20.

Figure 11:
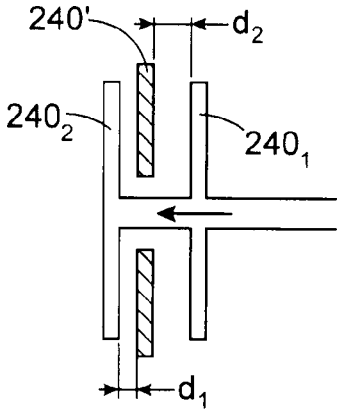

Preferably, as illustrated in FIG. 11, non symmetrical gaps are produced, when idle, between each mobile electrode and the stationary electrodes framing it. For example, the gap between a mobile electrode 240' and the first adjacent stationary electrode $\mathbf{240}_1$ (the first adjacent stationary electrode $\mathbf{240}_2$, respectively) is in the vicinity of ⅓ (⅔, respectively) of the distance between these two adjacent electrodes.

FIGS. 8A-8G illustrate an example of a method for producing a device according to the invention. In this example, the contacts are on the front face and the cavity 28 is in the rear face.

This method involves attaching a second substrate.

One starts (FIG. 8A) from a SOI substrate (with a buried oxide (BOX) 103, for example 0.5 μm thick). Alternatively, one starts from a standard substrate 101, on which a deposition 103 of a sacrificial layer (oxide) and a deposition 100 of a semi-conductor material, e.g. silicon or polycrystalline SiGe, is done.

Then, a metal deposition (ex: Ti/Au or AISi, . . . ) is done, as well as a lithography and etching of the contacts 30, 30'. It is possible to make the contacts on the rear face using the same technique.

Then, one performs (FIG. 8B) a lithography and etching of the superficial silicon layer to define the acoustic cavity 20 and the mechanical activation structure, in particular including the mobile or deformable wall 25 and the actuating elements (capacitive combs or thermal excitation means) the details of which are not shown here: the etching masks used are adapted to produce the suitable means as a function of the type of actuation done.

Figure 8A:
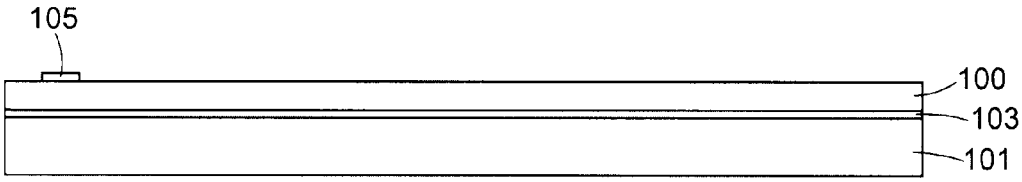
Figure 8B:
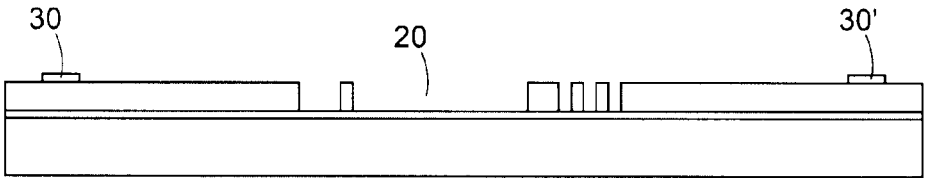
Figure 8C:
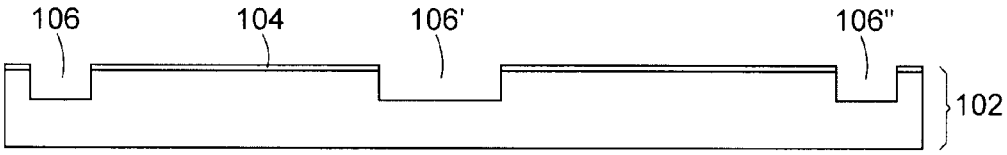
Figure 8D:
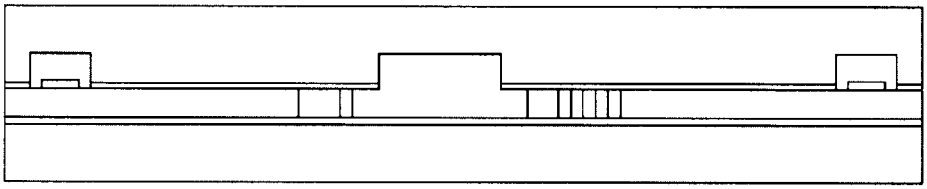
Figure 8E:
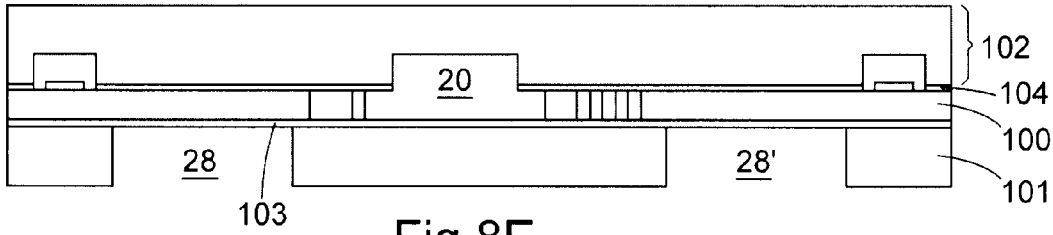

Furthermore, on a base of a traditional Si substrate 102, a deposition 104 of silicon oxide (SiO2) is done with a thickness of about 0.8 μm (FIG. 8C).

A lithography and etching (partial or complete) of the oxide 104 and the silicon 102 will then be done in order to form openings 106, 106', 106" for the entry of the pressure and the opening of the contacts.

The two substrates are then aligned (FIG. 8D) and sealed (by direct sealing, or eutectic, or polymer, or anodic, . . . ).

Lithography and etching (FIG. 8E) of openings of the cavities 28, 28' are then done on the rear face ("back volume").

Figure 8F:
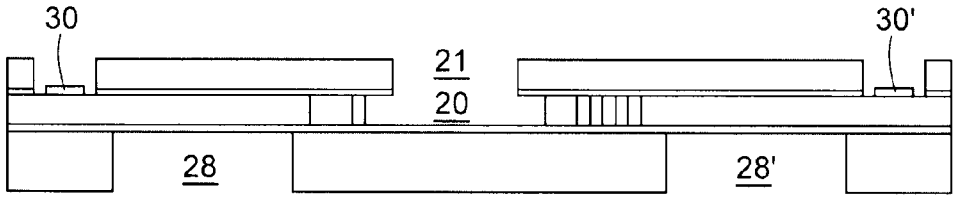
Figure 8G:
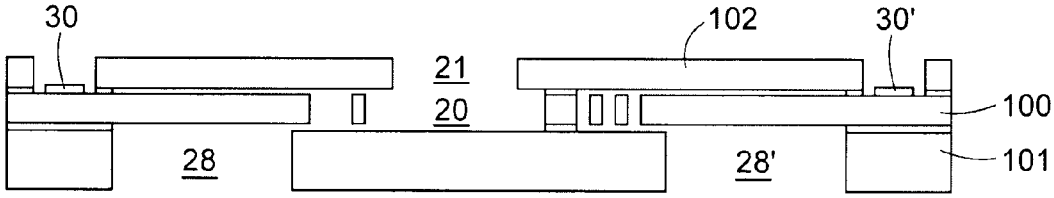

By thinning the front face ("back-grinding"), an opening of the cavities 21 and contacts 30, 30' is formed (FIG. 8F).

Lastly, the mobile structure (FIG. 8G) is freed by removing the parts of the sacrificial oxide layers 103, 104 by HF etching (e.g. steam).

Figure 9A:
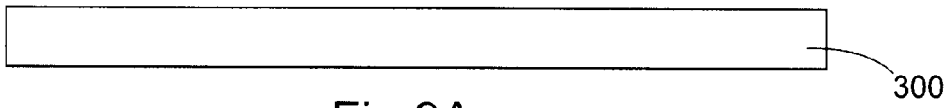
FIGS. 9A-9C show the steps of an alternative of another method for making a device according to the invention.

Following the same progression, the method starts with a standard substrate 300 (FIG. 9A), for example made from a semiconductor material such as silicon.

Figure 9B:
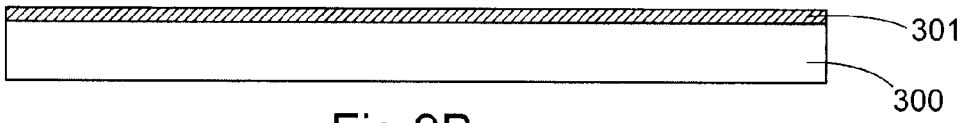

On that substrate, a deposition of a sacrificial layer 301 is done (FIG. 9B), for example an oxide layer, which, here again in an example, can have a thickness equal to about 0.5 μm.

Figure 9C:
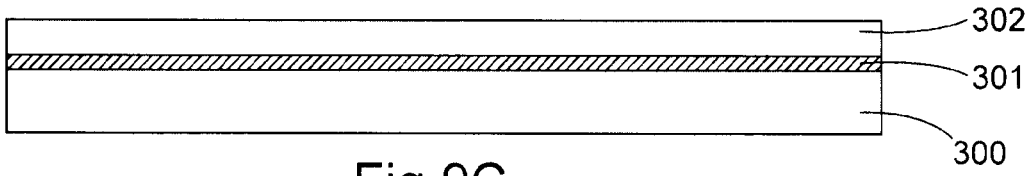

One then deposits, on the sacrificial layer 301, an active layer 302 of poly-Si or poly-SiGe (FIG. 9C) whereof the thickness can be, for example, about 10 μm. One then returns to the previous method from FIG. 8A.

In general, the sacrificial layers 103, 104 are for example between several tens of nm and several microns, for example between 100 nm or 500 nm and 1 μm or 2 μm. The active layers 100, 101, 102 (each is for example made from Si, or SiGe, . . . ) are between several μm and several tens of μm, or even several hundred μm, for example between 5 μm and 10 μm or 50 μm or 200 μm.

In the case of a closed cavity made on the substrate 102 (structure of FIG. 7A), it is possible to benefit from the step for etching the opening 21: the cavities 280, 280' can be etched at the same time as this opening 21.

In the case of a cavity open in the substrate 101 (structure of FIG. 4, for example), it is necessary to etch the opening 28 over the entire thickness of the substrate 101. This complicates the production method, but the "back-volume" is in this case more effective than in the case of FIG. 7A.

The invention applies to the production of pressure pulse generators for digital loudspeakers, in particular for general public applications (mobile telephones, games, MP3 players, television sets, . . . ).

It also applies to ultrasonic pulse generators for cMUT, in particular for medical or industrial applications (ultrasound probe, echography, non-destructive testing, . . . ).

It can also be used as a pneumatic actuator (e.g. as a pump, . . . ).

The invention claimed is:

1. A device for generating acoustic energy, comprising:

a substrate;

at least one deformable cavity disposed in the substrate and being delimited by at least one mobile or deformable wall, the at least one deformable cavity extending in a lateral direction in the substrate defined by a first plane parallel to an upper surface of the substrate;

at least one opening disposed in an upper portion of the at least one deformable cavity, configured to transmit at least one pulse produced in the at least one deformable cavity to an ambient atmosphere, the at least one pulse being a pressure pulse, a depression pulse, a partial vacuum pulse, or a combination thereof; and at least one actuator configured to generate a force in the first plane that displaces or deforms, or displaces and deforms, the at least one mobile or deformable wall.

2. The device for generating acoustic energy according to claim 1, wherein the device is a microelectromechanical (MEMS) device, a nanoelectromechanical (NEMS) device, a capacitive micromachined ultrasonic transducer (cMUT) device, or a combination thereof.

3. The device for generating acoustic energy according to claim 1, wherein the at least one mobile or deformable wall comprises at least one side wall extending in a direction perpendicular to the first plane.

4. The device for generating acoustic energy according to claim 1, wherein the at least one mobile or deformable wall is stationary or movable in the lateral direction defined by the first plane.

5. The device for generating acoustic energy according to claim 1, further comprising at least one secondary cavity, or at least one buffer cavity, in at least partial communication with the at least one deformable cavity.

6. The device for generating acoustic energy according to claim 5, wherein the at least one secondary cavity is disposed in the substrate.

7. The device for generating acoustic energy according to claim 1, further comprising:

a second substrate different from the substrate, extending in a direction defined by a second plane parallel to the first plane; and at least one secondary cavity disposed in the second substrate and in at least partial communication with the at least one deformable cavity, or disposed in the substrate and in at least partial communication with the at least one deformable cavity.

8. The device for generating acoustic energy according to claim 7, wherein the second substrate includes the at least one opening, or wherein the second substrate is disposed on one side of the substrate, and a third substrate is disposed on another side of the substrate opposite to said one side, the third substrate including the at least one opening and being configured to transmit the at least one pulse produced in the at least one deformable cavity to the ambient atmosphere.

9. The device for generating acoustic energy according to claim 1, wherein the at least one actuator is disposed in the substrate and in at least partial communication with the at least one mobile or deformable wall.

10. The device for generating acoustic energy according to claim 1, wherein the at least one actuator is at least one electrostatic actuator, at least one capacitive actuator, at least one thermal actuator, at least one piezoelectric actuator, or a combination thereof.

11. The device for generating acoustic energy according to claim 1, wherein the at least one actuator is a capacitive actuator, comprising:

at least one first set of electrostatic combs, comprising:

at least one first comb configured to be movable in the lateral direction defined by the first plane, and at least one second comb configured to be stationary, wherein the at least one first comb includes first comb teeth and the at least one second comb includes second comb teeth, the first comb teeth and the second comb teeth alternating and at least partially overlapping; and electrical contacts configured to apply an activation voltage to the at least one first set of electrostatic combs to move the first comb relative to the second comb.

12. The device for generating acoustic energy according to claim 1, wherein the at least one actuator includes:

a first actuator; and a second actuator, wherein the first actuator and the second actuator are disposed on opposite sides of the at least one deformable cavity in the lateral direction defined by the first plane, and are configured to generate the force in the first plane that displaces or deforms, or displaces and deforms, the at least one mobile or deformable wall in two opposite directions.

13. The device for generating acoustic energy according to any one of claims 9 to 12, the at least one actuator including:

at least one first actuator part configured to generate at least a first force in a first direction substantially perpendicular to a main surface of the at least one mobile or deformable wall, the main surface extending in a direction perpendicular to the first plane, at least one second actuator part configured to generate at least a second force in a second direction substantially perpendicular to the first direction, and at least one converter configured to convert the second force into a third force along the first direction.

14. The device for generating acoustic energy according to claim 11, the at least one actuator further comprising:

at least one second set of capacitive combs, the at least one first set of capacitive combs and the at least one second set of capacitive combs being disposed on opposite sides of the at least one deformable cavity in the lateral direction defined by the first plane, the at least one second set of capacitive combs comprising:

at least one third comb configured to be movable in the lateral direction defined by the first plane, and at least one fourth comb configured to be stationary, wherein the at least one third comb includes third comb teeth and the at least one fourth comb includes fourth comb teeth, the third comb teeth and the fourth comb teeth alternating and at least partially overlapping, and wherein at least one of the at least one first comb and the at least one second comb, and at least one of the at least one third comb and the at least one fourth comb, are configured to move in a first direction substantially perpendicular to a main surface of the at least one mobile or deformable wall, the main surface extending in a direction perpendicular to the first plane; and at least one third set of capacitive combs comprising at least one fifth comb and at least one sixth comb, wherein the at least one fifth comb includes fifth comb teeth and the at least one sixth comb includes sixth comb teeth, the fifth comb teeth and the sixth comb teeth alternating and at least partially overlapping, and wherein at least one of the at least one fifth comb and the at least one sixth comb are configured to move in a second direction perpendicular to the first direction.

15. The device for generating acoustic energy according to claim 1, wherein the at least one deformable cavity includes a plurality of deformable cavities arranged in parallel, at least two of the plurality of deformable cavities being configured to share a same actuator of the at least one actuator.

16. The device for generating acoustic energy according to claim 15, wherein the at least one opening includes a single opening in each cavity of the plurality of deformable cavities, or each cavity of the plurality of deformable cavities includes a membrane arranged on the single opening in the respective said each cavity of the plurality of deformable cavities, or each cavity of the plurality of deformable cavities includes a membrane arranged opposite the single opening in the respective said each cavity of the plurality of deformable cavities, or a combination thereof.

17. The device for generating acoustic energy according to claim 1, wherein the at least one mobile or deformable wall comprises two lateral ends, the at least one mobile or deformable wall:

being embedded or fastened at the two lateral ends, or being rigid and maintained at the two lateral ends by deformable elements, or being rigid and translatable.

18. A method for making a device for generating acoustic energy, comprising:

providing a substrate;

providing at least one deformable cavity disposed in the substrate and being delimited by at least one mobile or deformable wall, the at least one deformable cavity extending in a lateral direction in the substrate defined by a first plane parallel to an upper surface of the substrate and being in communication with an ambient atmosphere;

providing at least one opening disposed in an upper portion of the at least one deformable cavity, for transmitting at least one pulse produced in the at least one deformable cavity to the ambient atmosphere, the at least one pulse being a pressure pulse, a depression pulse, a partial vacuum pulse, or a combination thereof; and providing at least one actuator for generating a force in the first plane that displaces or deforms, or displaces and deforms, the at least one mobile or deformable wall.

19. The method according to claim 18, wherein the device is a microelectromechanical (MEMS) device, a nanoelectromechanical (NEMS) device, a capacitive micromachined ultrasonic transducer (cMUT) device, or a combination thereof.

20. The method according to claim 18, wherein the at least one mobile or deformable wall comprises at least one side wall extending in a direction perpendicular to the first plane.

21. The method according to claim 18, wherein the at least one mobile or deformable wall is stationary or movable in the lateral direction defined by the first plane.

22. The method according to claim 18, further comprising providing at least one secondary cavity, or at least one buffer cavity, in at least partial communication with the at least one deformable cavity.

23. The method according to claim 22, wherein the at least one secondary cavity is disposed in the substrate.

24. The method according to claim 18, further comprising:

providing a second substrate different from the substrate, extending in a direction defined by a second plane parallel to the first plane; and providing at least one secondary cavity disposed in the second substrate and in at least partial communication with the at least one deformable cavity, or disposed in the substrate and in at least partial communication with the at least one deformable cavity.

25. The method according to claim 24, wherein the second substrate includes the at least one opening, or wherein the second substrate is disposed on one side of the substrate, and providing a third substrate disposed on another side of the substrate opposite to said one side, the third substrate including the at least one opening for transmitting the at least one pulse produced in the at least one deformable cavity to the ambient atmosphere.

26. The method according to claim 18, wherein the at least one actuator is disposed in the substrate and in at least partial communication with the at least one mobile or deformable wall.

27. The method according to claim 24, the substrate and the second substrate being assembled via a dielectric layer to form a Silicon on Insulator (SOI) substrate.

* * * * *